US006679754B2

(12) United States Patent
Li et al.

(10) Patent No.: US 6,679,754 B2
(45) Date of Patent: Jan. 20, 2004

(54) DYEABLE POLYOLEFIN FIBERS AND FABRICS

(75) Inventors: Sheng-Shing Li, Danbury, CT (US); Andrew J. Leggio, Franklin Square, NY (US); Nadi Ergenc, Therwil (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/013,106

(22) Filed: Dec. 6, 2001

(65) Prior Publication Data

US 2002/0161123 A1 Oct. 31, 2002

Related U.S. Application Data

(60) Provisional application No. 60/251,638, filed on Dec. 6, 2000, and provisional application No. 60/277,823, filed on Mar. 22, 2001.

(51) Int. Cl.[7] ..... C08L 77/12; A61F 13/00; A61F 13/15; D04H 3/00; D04B 1/14

(52) U.S. Cl. ..... 448/365; 524/514; 525/167; 525/184; 442/199; 442/202; 442/311; 442/361; 604/358; 604/366; 604/367; 604/372; 428/373

(58) Field of Search ..... 525/167, 184; 524/514; 442/199, 202, 311, 361; 448/365, 373; 604/358, 366, 367, 372

(56) References Cited

U.S. PATENT DOCUMENTS

| | | | | |
|---|---|---|---|---|
| 3,487,453 | A | 12/1969 | Sheehan | 260/897 |
| 3,847,453 | A | 11/1974 | Herbert | 308/36.1 |
| 5,096,995 | A | 3/1992 | Fukumoto et al. | 528/125 |
| 5,140,065 | A | 8/1992 | Dalla Torre et al. | 525/66 |
| 5,604,284 | A | 2/1997 | Ueda et al. | 524/434 |
| 5,652,326 | A | 7/1997 | Ueda et al. | 528/288 |
| 5,886,098 | A | 3/1999 | Ueda et al. | 525/66 |
| 5,965,206 | A | 10/1999 | Hilti et al. | 427/393.1 |
| 5,985,999 | A | 11/1999 | Dominguez et al. | 525/74 |

FOREIGN PATENT DOCUMENTS

| | | |
|---|---|---|
| GB | 2112789 | 7/1983 |
| GB | 2112795 | 7/1983 |
| WO | 97/47684 | 12/1997 |

*Primary Examiner*—Ana Woodward
(74) *Attorney, Agent, or Firm*—Tyler A. Stevenson

(57) ABSTRACT

Polyolefin fibers, filaments and fabrics made therefrom which comprise a melt blend which comprises (A) a polyolefin; and (B) at least one polyetheresteramide which contains aromatic diol-derived sections, exhibit excellent durable dyeability. The fabrics are useful in woven garments, carpeting, furniture and automobile upholstery, woven industrial fabrics, non-woven absorbents used in disposable diapers, non-woven garments including disposable medical garments, filter media, synthetic paper and the like.

20 Claims, No Drawings

DYEABLE POLYOLEFIN FIBERS AND FABRICS

This application claims the benefit under 35 USC 119(e) of U.S. Provisional Application Serial Nos. 60/251,638 filed Dec. 6, 2000 and 60/277,823, filed Mar. 22, 2001.

The present invention relates to novel olefin polymer fibers and fabrics that exhibit excellent dyeability. The fibers are useful in garments, carpets, upholstery, disposable medical garments, diapers, and the like.

BACKGROUND

Polyolefins, for example polypropylene, have many advantageous physical properties. However, its inherent ability to be dyed is very poor. There is a long-felt need for dyeable polyolefin compositions, in particular polypropylene fiber.

Most often, colored polypropylene in fiber form is obtained by the addition of solid pigments. Unfortunately, fibers with solid pigment are not nearly as vibrant as dyed fibers. Further, due to their limited number, pigments offer a significantly reduced spectrum of choices as compared to dyes. Likewise, use of pigments restricts the patterns that can be applied to an article of clothing prepared from polypropylene. Certain pigments, additionally, affect the drawability and final properties of the polypropylene fiber. Other polyolefins such as polyethylene possess similar disadvantages. A continuing need exists for dyeable polyolefin compositions, for example polypropylene fibers.

U.S. Pat. No. 5,096,995 discloses polyetheresteramides with aromatic backbones.

U.S. Pat. No. 3,487,453 discloses the improvement of dye receptivity of polypropylene fiber by the addition of an aromatic polyetherester.

U.S. Pat. No. 5,140,065 discloses pigment-compatible thermoplastic molding compositions that comprise a block polyetherpolyamide, a block polyetheresterpolyamide, an amorphous copolyamide and a modified copolyolefin.

U.S. Pat. Nos. 5,604,284, 5,652,326 and 5,886,098 disclose antistatic resin compositions comprising a certain polyetheresteramide additive.

U.S. Pat. No. 5,985,999 discloses a dyeable polyolefin composition comprising the reaction product of a functionalized polypropylene and polyetheramine in which the polyetheramine is grafted onto the functionalized polypropylene.

GB 2112789 discloses polyolefin compositions with polyetheresteramides that have improved shock-resistance properties at low temperature, improved dyeing affinity and antistatic properties.

GB 2112795 discloses polyolefin textile compositions with polyetheresteramides that exhibit improved dyeability and improved antistatic properties.

WO 97/47684 discloses polypropylene compositions that show affinity for dispersion dyes that comprise isotactic polypropylene, a copolyamide, and an EVA copolymer.

Surprisingly, it has been found that a specific class of polyetheresteramides are especially effective towards imparting dyeability to polyolefin fibers and fabrics when incorporated therein as melt additives.

DETAILED DISCLOSURE

The present invention pertains to a dyeable fiber or filament, comprising a melt blend which comprises (A) a polyolefin; and (B) at least one polyetheresteramide which contains aromatic diol-derived sections, wherein the aromatic diols are selected from the group consisting of (I)

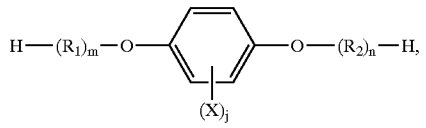

(II)

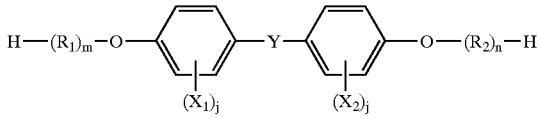

and (III)

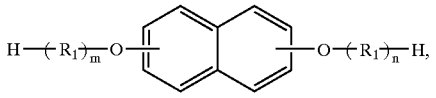

wherein $R_1$ and $R_2$ independently are ethylene oxide or propylene oxide,

Y is a covalent bond, an alkylene group of 1 to 6 carbon atoms, an alkylidene group, a cycloalkylidine group, an arylalkylidene group, O, SO, $SO_2$, CO, S, $CF_2$, $C(CF_3)_2$, or NH, X is alkyl having 1 to 6 carbon atoms, halogen, sulfonic acid or sulfonic acid salt, $X_1$ and $X_2$ are independently straight or branched alkyl of 1 to 6 carbon atoms, aralkyl of 6 to 10 carbon atoms, aryl, halogen, sulfonic acid or sulfonic acid salt, j is 0 to 4 and m and n are independently 1 to 32.

The polyetheresteramide additives of component (B) encompass those described in U.S. Pat. Nos. 5,096,995, 5,604,284, 5,652,326 and 5,886,098 each hereby incorporated by reference. The present polyetheresteramides may be prepared by the methods disclosed in these references.

Polyetheresteramides of U.S. Pat. No. 5,096,995

The polyetheresteramides of U.S. Pat. No. 5,096,995 with aromatic polyether sections are prepared by copolymerizing the components (a) an aminocarboxylic acid, a lactam, or a salt synthesized from a diamine and a dicarboxylic acid; (b) at least one diol selected from the group consisting of aromatic compounds of formulae (I), (II) and (III) as above; (c) at least one diol compound selected from the group consisting of poly(alkyleneoxide)glycols and diols HO—$R_3$—OH where $R_3$ is an alkylene, alkylidene, cycloalkylidene or arylalkylidene group having 2 to 16 carbon atoms; and (d) a dicarboxylic acid of 4 to 20 carbon atoms; wherein the content of the polyether-ester units is 10 to 90% by weight.

The compounds of (c), poly(alkyleneoxide)glycols, are for example polyethylene glycol or polypropylene glycol.

Polyetheresteramides of U.S. Pat. Nos. 5,604,284, 5,652,326 and 5,886,098

The polyetheresteramide of U.S. Pat. Nos. 5,604,284, 5,652,326 and 5,886,098 consists essentially of the two components of a polyamide oligomer with carboxylic chain ends having a number average molecular weight from 200 to 5,000 and a bisphenol compound containing oxyalkylene units and having a number average molecular weight from 300 to 3,000.

The terms "bisphenol compound containing oxyalkylene units" and "oxyalkylated bisphenol" of U.S. Pat. Nos. 5,604,284, 5,652,326 and 5,886,098, corresponds to "aromatic diol" of formula (II) in terms of the present invention.

By the term "essentially" as mentioned herein it should be understood that although the polyetheresteramide of the present invention may practically be composed of the two components explained above, it is allowed to add a third component to the polymer within the range not deteriorating the object and the advantageous effect of the invention.

Compounds used to form the polyamide oligomers mentioned above are amino carboxylic acids, lactams and salts of diamines and dicarboxylic acids. Examples of amino carboxylic acids are ω-amino caproic acid, ω-aminoenanthic acid, ω-aminocaprylic acid, ω-aminoperalgonic acid, ω-aminocapric acid, 11-aminodecanoic acid and 12-aminodecanoic acid. Examples of lactams are caprolactam, enantholactam, caprylolactam and laurolactam. Diamines as the components of the salts mentioned above are hexamethylene diamine, heptamethylene diamine, octamethylene diamine and decamethylene diamine, and dicarboxylic acids are adipic acid, azelaic acid, sebacic acid, undecane dicarboxylic acid, dodecane dicarboxylic acid and isophthalic acid. Examples among these compounds are caprolactam, 12-aminododecanoic acid and salt of adipic acid and hexamethylene diamine.

Polyamide oligomers with carboxylic chain ends having a number average molecular weight from 200 to 5,000 are obtained by the ring opening polymerization or polycondensation of the polyamide forming components in the presence of a molecular weight modifier. As molecular weight modifier dicarboxylic acids with from 4 to 20 carbons are usually used, more specifically aliphatic dicarboxylic acids such as succinic acid, glutaric acid, adipic acid, pimelic acid, suberic acid, azelaic acid, sebacic acid, undecane dicarboxylic acid and dodecane dicarboxylic acid; aromatic dicarboxylic acids such as terephthalic acid, isophthalic acid, phthalic acid, naphthalene dicarboxylic acid and 3-sulfoisophthalic acid alkali metal salt; and alicyclic dicarboxylic acids such as 1,4-cyclohexane dicarboxylic acid, dicyclohexyl-4,4'-dicarboxylic acid. Halogeno or sulfoxyl derivatives of these carboxylic acids are also used. Examples among these compounds are aliphatic dicarboxylic acids and aromatic dicarboxylic acids, more preferable are adipic acid, sebacic acid, terephthalic acid, isophthalic acid and 3-sulfoisophthalic acid alkali metal salt.

Examples of bisphenol compounds are dihydroxydiphenyl, C-alkyl substituted bisphenol; halogenated bisphenol; alkylene bisphenols such as bisphenol F; alkylidene bisphenols such as bisphenol A, cyclohexylidene bisphenol and bistrifluoromethyl methylene bisphenol; aryl alkylidene bisphenol; bisphenol S and hydroxybenzophenone. Specific examples among these compounds are alkylidene bisphenols, for example bisphenol A.

The oxyalkylene units which are included in the bisphenol compounds of U.S. Pat. Nos. 5,604,284, 5,652,326 and 5,886,098 are oxyethylene unit, oxypropylene unit, 1- or 2-oxybutylene unit and oxytetramethylene unit. Examples among these oxyalkylene units are oxyethylene unit or the combination of oxyethylene and oxypropylene units.

The bisphenol compounds containing oxyalkylene units, namely oxyalkylated bisphenol compounds, may have a number average molecular weight ranging from 300 to 3,000, for example from 1,600 to 3,000. For instance the bisphenol compounds containing from 32 to 60 oxyethylene units are advantageously employed.

The polyetheresteramide of U.S. Pat. Nos. 5,604,284, 5,652,326 and 5,886,098 is obtained by the polycondensation of the above described polyamide oligomer and bisphenol compound in the presence of a known catalyst such as antimony trioxide, monobutyl tin oxide, tetrabutyl titanate, tetrabutyl zirconate and zinc acetate according to need. It is advantageous that the bisphenol chains with oxyalkylene units be contained in the amount of from 20 to 80% by weight of the polyetheresteramide. The relative viscosity of the polyetheresteramide is for instance in the range from 0.5 to 4.0, for example from 0.6 to 3.0. Relative viscosity is measured as a 0.5% by weight solution of the polyetheresteramide in m-cresol at 25° C.

For example, the polyetheresteramide of the present invention may be the reaction product of the ethylene oxide adduct of bisphenol A with an oligomer with carboxyl chain ends prepared from ε-caprolactam and adipic acid.

The polyetheresteramides of the present invention, containing bisphenol compounds, that is aromatic diol-derived groups, provide excellent dyeability to polyolefin fibers, filaments and fabrics.

The compositions of the present invention may comprise additive mixtures of two or more different polyetheresteramides of component (B).

As used herein, the terms "fiber" or "filament" refers to a flexible, synthetic, macroscopically homogeneous body having a high ratio of length to width and being small in cross section. These fibers may be produced by any of the processes known in the art, including but not limited to direct profile extrusion, and slit or fibrillated tapes. Hence, it is contemplated that the compositions of this invention are useful in the preparation of dyeable fibers including dyeable woven and non-woven polyolefin fibers.

The present compositions are prepared by melt extrusion processes to form fibers or filaments. In accordance with known technology such as continuous filament spinning for yarn or staple fiber, and nonwoven processes such as spunbond production and meltblown production, the fibers or filaments are formed by extrusion of the molten polymer through small orifices. In general, the fibers or filaments thus formed are then drawn or elongated to induce molecular orientation and affect crystallinity, resulting in a reduction in diameter and an improvement in physical properties. In nonwoven processes such as spunbonding and meltblowing, the fibers or filaments are directly deposited onto a foraminous surface, such as a moving flat conveyor and are at least partially consolidated by any of a variety of means including, but not limited to, thermal, mechanical or chemical methods of bonding. It is known to those skilled in the art to combine processes or the fabrics from different processes to produce composite fabrics which possess certain desirable characteristics. Examples of this are combining spunbond and meltblown to produce a laminate fabric that is best known as SMS, meant to represent two outer layers of spunbond fabric and an inner layer of meltblown fabric. Additionally either or both of these processes may be combined in any arrangement with a staple fiber carding process or bonded fabrics resulting from a nonwoven staple fiber carding process. In such described laminate fabrics, the layers are generally at least partially consolidated by one of the means listed above.

The invention is also applicable to melt extruded bi-component fibers, wherein one of the components is a polyolefin according to this invention.

Non-woven fabrics of polyolefin may have a carded fiber structure or comprise a mat in which the fibers or filaments are distributed in a random array. The fabric may be formed by any one of numerous known processes including hydroentanglement or spun-lace techniques, or by air laying or melt-blowing filaments, batt drawing, stitchbonding, etc., depending upon the end use of the article to be made from the fabric.

Spunbond filament sizes are from about 1.0 to about 3.2 denier. Melblown fibers typically have a fiber diameter of less than 15 microns and typically are less than 5 microns, ranging down to the submicron level. Webs in a composite construction may be processed in a wide variety of basis weights. The size of the fiber will depend on the end use. For instance, heavier fibers are often employed for carpet backing as opposed to fibers used to make clothing apparel and the like. The fibers of the present invention may be for example from about 1 to about 1500 denier.

Thermoplastic polypropylene fibers, which are typically extruded at temperatures in the range of from about 210° to about 240° C., are inherently hydrophobic in that they are essentially non-porous and consist of continuous molecular chains incapable of attracting or binding to dyes. As a result, untreated polypropylene fabrics, even while having an open pore structure, tend to resist the application of dyes.

According to the present invention, a polyetheresteramide additive is incorporated into a thermoplastic polyolefin, such as polypropylene, in the melt, and is extruded with the polyolefin into the form of fibers and filaments which are then quenched, attenuated and formed into fabrics, either in a subsequent or concomitant processing step.

The polyetheresteramide may be compounded with the polymer pellets which are to be melt extruded. To improve processing, the polyetheresteramide may be preformulated or compounded into a low MFR polypropylene which may also contain a small amount of inorganic powder, such as talc, and other traditional stabilizers.

The mixing of the polyetheresteramide into the polyolefin is done by mixing it into molten polymer by commonly used techniques such as roll-milling, mixing in a Banbury type mixer, or mixing in an extruder barrel and the like. The heat history (time at which held at elevated temperature) can be shortened by mixing the polyetheresteramide with unheated polymer particles so as to achieve substantially even distribution of the agent in the mass of polymer, thereby reducing the amount of time needed for intensive mixing at molten temperature.

Conveniently, the polyetheresteramide additive can also be added substantially simultaneously or sequentially with any other additives which may be desired in certain instances. The polyetheresteramide may also be preblended with other additives and the blend then added to the polymer. It is contemplated that in some instances the polyetheresteramide may have the additional benefit of aiding the other additives to become more easily or evenly dispersed or dissolved in the polyolefin. For easier batch-to-batch control of quality, it may be preferred to employ concentrated masterbatches of polymer/additive blends which are subsequently blended, as portions, to additional quantities of polymer to achieve the final desired formulation. The masterbatch, or the neat additives, may be injected into freshly prepared polymer while the polymer is still molten and after it leaves the polymerization vessel or train, and blended therewith before the molten polymer is chilled to a solid or taken to further processing.

The weight ratio of the polyetheresteramides of component (B) to the polyolefin of component (A) in the compositions of the present invention, (B):(A), is from about 0.1:99.9 to about 40:60. For many applications, the polyetheresteramide is present from about 0.1% to about 15% based on the weight of component (A), for example from about 1% to about 7% by weight based on the weight of component (A).

The incorporation of the polyetheresteramide of component (B) into a polyolefin fiber or filament according to the present invention results in observed improved dyeability of these naturally hydrophobic materials. This modification is also durable, such that the fibers or filaments and fabrics made therefrom do not lose their dyeability upon aging or handling. The improved dyeability is stable to repeated washings without a loss of performance, even over extended time periods.

Hence, the present invention also pertains to a method for imparting permanent dyeability to a polyolefin fiber, filament and woven or nonwoven fabrics made therefrom, comprising melt extruding a mixture comprising a thermoplastic polyolefin and at least one polyetheresteramide of component (B).

The present invention is aimed at nonwoven fabrics, for example polypropylene fabrics. It is also aimed at threads or yarns for weaving or knitting in conventional textile processes.

The additives of the present invention are effective irrespective of other factors that influence the properties of nonwoven fabrics, for example, basis weight, fiber diameter, degree and type of bonding of the fibers, and the synergistic effects and influence of composite structures, such as the already describes SMS structures.

The present invention is not limited to single-component fibers. Polyolefin bi-component fibers, particularly side-by-side or sheath-core fibers of polypropylene and polyethylene would be expected to demonstrate the same practical benefits as single component fibers of either type.

The dyeable fabrics prepared from the fibers and filaments of the present invention include woven garments (outerwear and underwear); carpeting; furniture and automobile upholstery, woven industrial fabrics; non-woven absorbents used in diapers, sanitary pads, incontinence pads, wet and dry wipes, wound dressings, spill abatement, and medical absorbent pads; non-woven garments, including disposable medical garments; felts; pressed sheets; geo-textiles; filters (bipolar); packaging materials, including envelopes, and synthetic paper.

The fabrics of the present invention may be sterilized by exposure to about 0.5 to about 10 megarads of gamma irradiation. Sterilization with gamma irradiation is employed for hospital garments and the like.

Examples for polyolefins of component (A) are:

1. Polymers of monoolefins and diolefins, for example polypropylene, polyisobutylene, polybut-1-ene, poly-4-methylpent-1-ene, polyisoprene or polybutadiene, as well as polymers of cycloolefins, for instance of cyclopentene or norbornene, polyethylene (which optionally can be crosslinked), for example high density polyethylene (HDPE), high density and high molecular weight polyethylene (HDPE-HMW), high density and ultrahigh molecular weight polyethylene (HDPE-UHMW), medium density polyethylene (MDPE), low density polyethylene (LDPE), linear low density polyethylene (LLDPE), (VLDPE) and (ULDPE).

Polyolefins, i.e. the polymers of monoolefins exemplified in the preceding paragraph, for example polyethylene and polypropylene, can be prepared by different, and especially by the following, methods:

i) radical polymerization (normally under high pressure and at elevated temperature).

ii) catalytic polymerization using a catalyst that normally contains one or more than one metal of groups IVb, Vb, VIb or VIII of the Periodic Table. These metals usually have one or more than one ligand, typically oxides, halides, alcoholates, esters, ethers, amines, alkyls, alkenyls and/or aryls that may be either p- or s-coordinated. These metal complexes may be in the free form or fixed on substrates, typically on activated magnesium chloride, titanium(III) chloride, alumina or silicon oxide. These catalysts may be soluble or insoluble in the polymerization medium. The catalysts can be used by themselves in the polymerization or further activators may be used, typically metal alkyls, metal hydrides, metal alkyl halides, metal alkyl oxides or metal alkyloxanes, said metals being elements of groups Ia, IIa and/or IIIa of the Periodic Table. The activators may be modified conveniently with further ester, ether, amine or silyl ether groups. These catalyst systems are usually termed Phillips, Standard Oil Indiana, Ziegler (-Natta), TNZ (DuPont), metallocene or single site catalysts (SSC).

2. Mixtures of the polymers mentioned under 1.), for example mixtures of polypropylene with polyisobutylene, polypropylene with polyethylene (for example PP/HDPE, PP/LDPE) and mixtures of different types of polyethylene (for example LDPE/HDPE).

3. Copolymers of monoolefins and diolefins with each other or with other vinyl monomers, for example ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethyleneiheptene copolymers, ethylene/octene copolymers, propylene/butadiene copolymers, isobutylene/isoprene copolymers, ethylene/alkyl acrylate copolymers, ethylene/alkyl methacrylate copolymers, ethylene/vinyl acetate copolymers and their copolymers with carbon monoxide or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

Polyolefins of the present invention are for example polypropylene homo- and copolymers and polyethylene homo- and copolymers. For instance, polypropylene, high density polyethylene (HDPE), linear low density polyethylene (LLDPE) and polypropylene random and impact copolymers.

It is within the purview of the present invention to employ blends or alloys of olefin polymers.

The present polyolefin fibers, filaments and fabrics may also have incorporated or applied thereto appropriate additives such as ultraviolet light absorbers, hindered amine light stabilizers, antioxidants, processing aids and other additives.

For example, the compositions of the invention may optionally also contain from about 0.01 to about 10%, preferably from about 0.025 to about 5%, and especially from about 0.1 to about 3% by weight of various conventional stabilizer coadditives, such as the materials listed below, or mixtures thereof.

1. Antioxidants 1.1. Alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphen example, 2,6-di-nonyl-4-methylphenol, 2,4-dimethyl-6-(1-methylundec-1-yl) phenol, 2,4-dimethyl-6-(1-methylheptadec-1-yl) phenol, 2,4-dimethyl-6-(1-methyltridec-1-yl)phenol and mixtures thereof.

1.2. Alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-di-dodecylthiomethyl-4-nonylphenol.

1.3. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl) adipate.

1.4. Tocopherols, for example α-tocopherol, β-tocopherol, γ-tocopherol, δ-tocopherol and mixtures thereof (Vitamin E).

1.5. Hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis(2,6-dimethyl-4-hydroxyphenyl)disulfide.

1.6. Alkylidenebisphenols, for example 2,2'-methylenebis (6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis (4-methyl-6-cyclohexylphenol), 2,2'-methylenebis(6-nonyl4-methylphenol), 2,2'-methylenebis(4,6-di-tert-butylphenol), 2,2'-ethylidenebis (4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis (3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercaptobutane, ethylene glycol bis[3,3-bis(3-tert-butyl-4-hydroxyphenyl)butyrate], bis(3-tert-butyl-4-hydroxy-5-methyl-phenyl)dicyclopentadiene, bis[2-(3'tert-butyl-2-hydroxy-5-methylbenzyl)-6-tert-butyl-4-methylphenyl]terephthalate, 1,1-bis-(3,5-1,1,5,5-tetra-(5-tert-butyl-4-hydroxy-2-methylphenyl)pentane.

1.7. Benzyl compounds, for example 3,5,3',5'-tetra-tert-butyl-4,4'-dihydroxydibenzyl ether, octadecyl-4-hydroxy-3,5-dimethylbenzylmercaptoacetate, tridecyl-4-hydroxy-3,5-di-tert-butylbenzylmercaptoacetate, tris(3,5-di-tert-butyl-4-hydroxybenzyl)amine, 1,3,5-tri-(3,5-di-tert-butyl-4-hydroxybenzyl)-2,4,6-trimethylbenzene, di-(3,5-di-tert-butyl-4-hydroxybenzyl) sulfide, 3,5-di-tert-butyl-4-hydroxybenzyl-mercapto-acetic acid isooctyl ester, bis-(4-tert-butyl-3-hydroxy-2,6-dimethylbenzyl)dithiol terephthalate, 1,3,5-tris-(3,5-di-tert-butyl-4-hydroxybenzyl) isocyanurate, 1,3,5-tris-(4-tert-butyl-3-hydroxy-2,6-dimethylbenzyl) isocyanurate, 3,5-di-tert-butyl-4-hydroxybenzyl-phosphoric acid dioctadecyl ester and 3,5-di-tert-butyl-4-hydroxybenzyl-phosphoric acid monoethyl ester, calcium-salt.

1.8. Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl)malonate.

1.9. Aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris (3,5-di-tert-butyl-4-hydroxybenzyl)phenol.

1.10. Triazine compounds, for example 2,4-bis (octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis (3,5-di-tert-butyl-4-hydroxyphenoxy)-1,3,5-triazine, 2,4,6-tris-(3,5-di-tert-butyl-4-hydroxyphenoxy)-1,2,3-triazine, 1,3,5-tris-(3, 5-di-tert-butyl-4-hydroxy-benzyl)isocyanurate, 1,3,5-tris(4-tert-butyl-3-hydroxy-2,6-dimethylbenzyl) isocyanurate, 2,4,6-tris(3, 5-di-tert-butyl-4-hydroxyphenylethyl)-1,3,5-triazine, 1,3,5-tris(3,5-di-tert-butyl-4-hydroxy-phenylpropionyl)-hexahydro-1,3, 5-triazine, 1,3,5-tris(3,5-dicyclohexyl4-hydroxybenzyl)isocyanurate.

1.11. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzylphosphonate, dioctadecyl-5-tert-butyl 4-hydroxy-3-methylbenzylphosphonate, the calcium salt of the monoethyl ester of 3,5-di-tert-butyl-4-hydroxybenzylphosphonic acid.

1.12. Acylaminophenols, for example 4-hydroxy-lauric acid anilide, 4-hydroxy-stearic acid anilide, 2,4-bis-octylmercapto-6-(3,5-tert-butyl-4-hydroxyanilino)-s-triazine and octyl-N-(3,5-di-tert-butyl-4-hydroxyphenyl)-carbamate.

1.13. Esters of β-(3,5-di-tert-butyl-4-hydroxyphenyl) propionic acid with mono- or polyhydric alcohols, e.g. with methanol, ethanol, n-octanol, i-octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6, 7-trioxabicyclo[2.2.2]octane.

1.14. Esters of β-(5-tert-butyl-4-hydroxy-3-methylphenyl)propionic acid with mono- or polyhydric alcohols, e.g. with methanol, ethanol, n-octanol, i-octanol, octadecanol, 1,6-hexane-diol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis-(hydroxyethyl)oxamide, 3-thiaundecanol, 3-thiapentadecanol, trimethylhexanediol, trimethyl-olpropane, 4-hydroxymethyl-1-phospha-2,6,7-trioxabicyclo [2.2.2]octane.

1.15. Esters of β-(3,5-dicyclohexyl-4-hydroxyphenyl) propionic acid with mono- or polyhydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6, 7-trioxabicyclo[2.2.2]octane.

1.16. Esters of 3,5-di-tert-butyl-4-hydroxyphenyl acetic acid with mono- or polyhydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)ox-amide, 3-thiaundecanol, 3-thiapentadecanol, trimethylhexanediol, trimethylolpropane, 4-hy-droxymethyl-1-phospha-2,6, 7-trioxabicyclo[2.2.2]octane.

1.17. Amides of β-(3,5-di-tert-butyl-4-hydroxyphenyl) propionic acid e.g. N,N'-bis(3,5-di-tert-butyl-4-hydroxyphenylpropionyl)hexamethylenediamide, N,N'-bis(3,5-di-tert-butyl-4-hydroxyphenylpropionyl) trimethylenediamide, N,N'-bis(3,5-di-tert-butyl-4-hydroxyphenylpropionyl)hydrazide, N,N'-bis[2-(3-[3, 5-di-tert-butyl-4-hydroxyphenyl]propionyloxy)ethyl] oxamide (Naugard®XL-1 supplied by Uniroyal).

1.18. Ascorbic acid (vitamin C)

1.19. Aminic antioxidants, for example N,N'-di-isopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethylbutyl) N-phenyl-1-naphthylamine, N-(4-tert-octylphenyl)-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl) amine, 2,6-di-tert-butyl-4-dimethylaminomethylphenol, 2,4'-diaminodiphenylmethane, 4,4'-diaminodiphenylmethane, N,N, N', N'-tetramethyl-4,4'-diaminodiphenylmethane, 1,2-bis[(2-methylphenyl) amino]ethane, 1,2-bis(phenylamino)propane, (o-tolyl) biguanide, bis[4-(1',3'-dimethylbutyl)phenyl]amine, tert-octylated N-phenyl-1-naphthylamine, a mixture of mono- and dialkylated tert-butyl/tert-octyl-diphenylamines, a mixture of mono- and dialkylated nonyldiphenylamines, a mixture of mono-and dialkylated dodecyldiphenylamines, a mixture of mono- and dialkylated isopropyl/isohexyldiphenylamines, a mixture of mono- and dialkylated tertbutyldiphenylamines, 2,3-dihydro-3,3-dimethyl-4H-1,4-benzothiazine, phenothiazine, a mixture of mono- and dialkylated tert-butyl/tert-octylphenothiazines, a mixture of mono- and dialkylated tert-octylphenothiazines, N-allylphenothiazin, N,N,N',N'-tetraphenyl-1,4-diaminobut-2-ene, N N-bis-(2,2,6,6-tetramethyl-piperid-4-yl-hexamethylenediamine, bis(2,2,6,6-tetramethylpiperid-4-yl)-sebacate, 2,2,6,6-tetramethylpiperidin-4-one, 2,2,6,6-tetramethylpiperidin-4-ol.

2. UV absorbers and light stabilizers 2.1. 2-(2-Hydroxyphenyl)-2H-benzotriazoles, for example known commercial hydroxyphenyl-2H-benzotriazoles and benzotriazoles as disclosed in, U.S. Pat. Nos. 3,004,896; 3,055,896; 3,072,585; 3,074,910; 3,189,615; 3,218,332; 3,230,194; 4,127,586; 4,226,763; 4,275,004; 4,278,589; 4,315,848; 4,347,180; 4,383,863; 4,675,352; 4,681,905, 4,853,471; 5,268,450; 5,278,314; 5,280,124; 5,319,091; 5,410,071; 5,436,349; 5,516,914; 5,554,760; 5,563,242; 5,574,166; 5,607,987 and 5,977,219, such as 2-(2-hydroxy-5-methylphenyl)-2H-benzotriazole, 2-(3,5-di-t-butyl-2-hydroxyphenyl)-2H-benzotriazole, 2-(2-hydroxy-5-t-butylphenyl)-2H-benzotriazole, 2-(2-hydroxy-5-t-octylphenyl)-2H-benzotriazole, 5-chloro-2-(3,5-di-t-butyl-2-hydroxyphenyl)-2H-benzotriazole, 5-chloro-2-(3-t-butyl-2-h 2,2'-methylene-bis(4-t-octyl-(6-2H-benzotriazol-2-yl)phenol), 2-(2-hydroxy-3-α-cumyl-5-t-octylphenyl)-2H-benzotriazole, 2-(2-hydroxy-3-t-octyl-5-α-cumylphenyl)-2H-benzotriazole, 5-fluoro-2-(2-hydroxy-3,5-di-α-cumyl-phenyl)-2H-benzotriazole, 5-chloro-2-(2-hydroxy-3,5-di-α-cumylphenyl)-2H-benzotriazole, 5-chloro-2-(2-hydroxy-2-(3-t-butyl-2-hydroxy-5-(2-isooctyloxycarbonylethyl)phenyl)-5-chloro-2H-benzotriazole, 5-trifluoromethyl-2-(2-hydroxy-3-α-cumyl-5-t-octylphenyl)-2H-benzotriazole, 5-trifluoromethyl-2-(2-hydroxy-5-t-octylphenyl)-2H-benzotriazole, 5-trifluoromethyl-2-(2-hydroxy-3,5-di-t-octylphenyl)-2H-benzotriazole, methyl 3-(5-trifluoromethyl-2H-benzotriazol-2-yl)-5-t-butyl-4-hydroxyhydrocinnamate, 5-butylsulfonyl-2-(2-hydroxy-3-α-cumyl-5-t-octylphenyl)-2H-benzotriazole, 5-trifluoromethyl-2-(2-hydroxy-3-α-cumyl-5-t-butylphenyl)-2H-benzotriazole, 5-trifluoromethyl-2-(2-hydroxy-3,5-di-t-butylphenyl)-2H-benzotriazole, 5-trifluoromethyl-2-(2-hydroxy-3,5-di-α-c 2.2. 2-Hydroxybenzophenones, for example the 4-hydroxy, 4-methoxy, 4-octyloxy, 4-decyloxy, 4-dodecyloxy, 4-benzyloxy, 4,2',4'-trihydroxy and 2'-hydroxy-4,4'-dimethoxy derivatives.

2.3. Esters of substituted and unsubstituted benzoic acids, as for example 4-tertbutyl-phenyl salicylate, phenyl salicylate, octylphenyl salicylate, dibenzoyl resorcinol, bis(4-tert-butylbenzoyl) resorcinol, benzoyl resorcinol, 2,4-di-tert-butylphenyl 3,5-di-tert-butyl-4-hydroxybenzoate, hexadecyl 3,5-di-tert-butyl-4-hydroxybenzoate, octadecyl 3,5-di-tert-butyl-4-hydroxybenzoate, 2-methyl-4,6-di-tert-butylphenyl 3,5-di-tert-butyl4-hydroxybenzoate.

2.4. Acrylates and malonates, for example, α-cyano-β,β-diphenylacrylic acid ethyl ester or isooctyl ester, α-carbomethoxy-cinnamic acid methyl ester, α-cyano-β-methyl-p-methoxy-cinnamic acid methyl ester or butyl ester, α-carbomethoxy-p-methoxy-cinnamic acid methyl ester, N-(β-carbomethoxy-β-cyanovinyl)-2-methyl-indoline, Sanduvor® PR25, dimethyl p-methoxybenzylidenemalonate (CAS# 7443-25-6), and Sanduvor® PR31, di-(1,2,2,6,6-pentamethylpiperidin-4-yl) p-methoxybenzylidenemalonate (CAS # 147783-69-5).

2.5. Nickel compounds, for example nickel complexes of 2,2'-thio-bis-[4-(1,1,3,3-tetramethylbutyl)phenol], such as the 1:1 or 1:2 complex, with or without additional ligands such as n-butylamine, triethanolamine or N-cyclohexyldiethanolamine, nickel dibutyldithiocarbamate, nickel salts of the monoalkyl esters, e.g. the methyl or ethyl ester, of 4-hydroxy-3,5-di-tert -butylbenzylphosphonic acid, nickel complexes of ketoximes, e.g. of 2-hydroxy-4-methylphenyl undecylketoxime, nickel complexes of 1-phenyl-4-lauroyl-5-hydroxypyrazole, with or without additional ligands.

2.6. Sterically hindered amine stabilizers, for example 4-hydroxy-2,2,6,6-tetramethylpiperidine, 1-allyl-4-hydroxy-2,2,6,6-tetramethylpiperidine, 1-benzyl-4-hydroxy -2,2,6,6-tetramethylpiperidine, bis(2,2,6,6-tetramethyl-4-piperidyl) sebacate, bis(2,2,6,6-tetramethyl-4-piperidyl) succinate, bis(1,2,2,6,6-pentamethyl-4-piperidyl) sebacate, bis(1-octyloxy-2,2,6,6-tetramethyl-4-piperidyl) sebacate, bis(1,2,2,6,6-pentamethyl-4-piperidyl)n -butyl-3,5-di-tert-butyl-4-hydroxybenzylmalonate, the condensate of 1-(2-hydroxyethyl)-2,2,6,6-tetramethyl-4-hydroxypiperidine and succinic acid, linear or cyclic condensates of N,N'-bis(2,2,6,6-tetramethyl-4-piperidyl)hexamethylenediamine and 4-tert-octylamino-2,6-dichloro -1,3,5-triazine, tris(2,2,6,6-tetramethyl-4-piperidyl) nitrilotriacetate, tetrakis(2,2,6,6-tetramethyl-4-piperidyl)-1,2,3,4-butane-tetracarboxylate, 1,1'-(1,2-ethanediyl)-bis(3,3,5,5-tetramethylpiperazinone), 4-benzoyl-2,2,6,6-tetramethylpiperidine, 4-stearyloxy-2,2,6,6-tetramethylpiperidine, bis(1,2,2,6,6-pentamethylpiperidyl)-2-n-butyl-2-(2-hydroxy-3,5-di-tert -butylbenzyl)malonate, 3-n-octyl-7,7,9,9-tetramethyl-1,3,8-triazaspiro[4,5]decan-2,4-dione, bis (1-octyloxy-2,2,6,6-tetramethylpiperidyl) sebacate, bis (1-octyloxy-2,2,6,6-tetramethyl -piperidyl) succinate, linear or cyclic condensates of N,N'-bis-(2,2,6,6-tetramethyl-4-piperidyl) -hexamethylenediamine and 4-morpholino-2,6-dichloro-1,3,5-triazine, the condensate of 2-chloro-4,6-bis(4-n-butylamino-2,2,6,6-tetramethylpiperidyl)-1,3,5-triazine and 1,2-bis(3-amino -propylamino)ethane, the condensate of 2-chloro-4,6-di-(4-n-butylamino-1,2,2,6,6-pentamethylpiperidyl)-1,3,5-triazine and 1,2-bis-(3-aminopropylamino)ethane, 8-acetyl-3-dodecyl-7,7,9,9-tetramethyl-1,3,8-triazaspiro[4,5]decane-2,4-dione, 3-dodecyl-1-(2,2,6,6-tetramethyl-4-piperidyl) pyrrolidin-2,5-dione, 3-dodecyl-1-(1,2,2,6,6-pentamethyl-4-piperidyl)pyrrolidine-2,5-dione, a mixture of 4-hexadecyloxy-and 4-stearyloxy-2,2,6,6-tetramethylpiperidine, a condensation product of N,N'-bis(2,2,6,6-tetramethyl-4-piperidyl) hexamethylenediamine and 4-cyclohexylamino-2,6-dichloro-1,3,5-triazine, a condensation product of 1,2-bis(3-aminopropylamino)ethane and 2,4,6-trichloro-1,3,5-triazine as well as 4-butylamino-2,2,6,6-tetramethylpiperidine (CAS Reg. No. [136504-96-6]); N -(2,2,6,6-tetramethyl-4-piperidyl)-n-dodecylsuccinimid, N-(1,2,2,6,6-pentamethyl-4-piperidyl)-n -dodecylsuccinimid, 2-undecyl-7,7,9,9-tetramethyl-1-oxa-3,8-diaza-4-oxo-spiro[4,5]decane, a reaction product of 7,7,9,9-tetramethyl-2-cycloundecyl-1-oxa-3,8-diaza-4-oxospiro [4,5]decane and epichlorohydrin, 1,1-bis(1,2,2,6,6-pentamethyl-4-piperidyloxycarbonyl)-2-(4-methoxyphenyl)ethene, N,N'-bis-formyl-N,N'-bis(2,2,6,6-tetramethyl-4-piperidyl)hexamethylenediamine, diester of 4-methoxy-methylene-malonic acid with 1,2,2,6,6-pentamethyl-4-hydroxypiperidine, poly[methylpropyl-3-oxy-4-(2,2,6,6-tetramethyl-4-piperidyl)]siloxane, reaction product of maleic acid anhydride-α-olefin-copolymer with 2,2,6,6-tetramethyl4-aminopiperidine or 1,2,2,6,6-pentamethyl-4-aminopiperidine.

The sterically hindered amine may also be one of the compounds described in GB-A-2301106 as component l-a), l-b), l-c), l-d), l-e), l-f), l-g), l-h), l-i), l-j), l-k) or l-l), in particular the light stabilizer 1-a-1, 1-a-2, 1-b-1, 1-c-1, 1-c-2, 1-d-1, 1-d-2, 1-d-3, 1-e-1, 1-f-1, 1-g-1, 1-g-2 or 1-k-1 listed on pages 68 to 73 of said GB-A-2301106.

The sterically hindered amine may also be one of the compounds described in EP 782994, for example compounds as described in claims 10 or 38 or in Examples 1–12 or D-1 to D-5 therein.

2.7. Sterically hindered amines substituted on the N-atom by a hydroxy-substituted alkoxy group, for example compounds such as 1-(2-hydroxy-2-methylpropoxy)-4-octadecanoyloxy-2,2,6,6-tetramethylpiperidine, 1-(2-hydroxy-2-methylpropoxy)-4-hexadecanoyloxy-2,2,6,6-tetramethylpiperidine, the reaction product of 1-oxyl-4-hydroxy-2,2,6,6-tetramethylpiperidine with a carbon radical from t-amylalcohol, 1-(2-hydroxy-2-methylpropoxy)-4-hydroxy-2,2,6,6-tetramethylpiperidine, 1-(2-hydroxy-2-methylpropoxy)-4-oxo-2,2,6,6-tetramethylpiperidine, bis(1-(2-hydroxy-2-methylpropoxy)-2,2,6,6-tetramethylpiperidin-4-yl) sebacate, bis(1-(2-hydroxy-2-methylpropoxy)-2,2,6,6-tetramethylpiperidin4-yl) bis(1-(2-hydroxy-2-methylpropoxy)-2,2,6,6-tetramethylpiperidin-4-yl) succinate, bis(1-(2-hydroxy-2-methylpropoxy)-2,2,6,6-tetramethylpiperidin-4-yl) glutarate and 2,4-bis{N-[1-(2-hydroxy-2-methylpropoxy)-2,2,6,6-tetramethylpiperidin-4-yl]-N-butylamino}-6-(2-hydroxyethyl-amino)-s-triazine.

2.8. Oxamides, for example 4,4'-dioctyloxyoxanilide, 2,2'-diethoxyoxanilide, 2,2'-dioctyloxy-5,5'-di-tert-butoxanilide, 2,2'-didodecyloxy-5,5'-di-tert-butoxanilide, 2-ethoxy-2'-ethyloxanilide, N,N'-bis(3-dimethylaminopropyl)oxamide, 2-ethoxy-5-tert-butyl-2'-ethoxanilide and its mixture with 2-ethoxy-2'-ethyl-5,4'-di-tert-butoxanilide, mixtures of o- and p-methoxy-disubstituted oxanilides and mixtures of o- and p-ethoxy-disubstituted oxanilides.

2.9. Tris-aryl-o-hydroxyphenyl-s-triazines, for example known commercial tris-aryl-o-hydroxyphenyl-s-triazines and triazines as disclosed in, WO 96/28431, EP 434608, EP 941989, GB 2,317,893, U.S. Pat. Nos. 3,843,371; 4,619,956; 4,740,542; 5,096,489; 5,106,891; 5,298,067; 5,300,414; 5,354,794; 5,461,151; 5,476,937; 5,489,503; 5,543,518; 5,556,973; 5,597,854; 5,681,955; 5,726,309; 5,942,626; 5,959,008; 5,998,116 and 6,013,704, for example 4,6-bis-(2,4-dimethylphenyl)-2-(2-hydroxy-4-octyloxyphenyl)-s-triazine, Cyasorb® 1164, Cytec Corp, 4,6-bis-(2,4-dimethylphenyl)-2-(2,4-dihydroxyphenyl)-s-triazine, 2,4-bis(2,4-dihydroxyphenyl)-6-(4-chlorophenyl)-s-triazine, 2,4-bis[2-hydroxy-4-(2-hydroxy-ethoxy) phenyl]-6-(4-chlorophenyl)-s-triazine, 2,4-bis[2-hydroxy-4-(2-hydroxy-4-(2-hydroxy-ethoxy)phenyl]-6-(2,4-dimethylphenyl)-s-triazine, 2,4-bis[2-hydroxy-4-(2-hydroxyethoxyl)phenyl]-6-(4-bromophenyl)-s-triazine, 2,4-bis[2-hydroxy-4-(2-acetoxyethoxy) phenyl]-6-(4-chlorophenyl)-s-triazine, 2,4-bis (2,4-dihydroxyphenyl)-6-(2,4-dimethylphenyl)-s-triazine, 2,4-bis(4-biphenylyl)-6-(2-hydroxy-4-octyloxycarbonylethylideneoxyphenyl)-s-triazine, 2-phenyl-4-[2-hydroxy-4-(3-sec-butyloxy-2-hydroxypropyloxy)phenyl]-6-[2-hydroxy-4-(3-sec-amyloxy-2-hydroxypropyloxy)-phenyl]-s-triazine, 2,4-bis(2,4-dimethylphenyl)-6-[2-hydroxy-4-(3-benzyloxy-2-hydroxy-propyloxy)phentl]-s-triazine, 2,4-bis(2-hydroxy-4-n-butyloxy methylenebis-{2,4-bis (2,4-dimethylphenyl)-6-[2-hydroxy-4-(3-butyloxy-2-hydroxypropoxy)-phenyl]-s-triazine}, methylene bridged dimer mixture bridged in the 3:5', 5:5' and 3:3' positions in a 5:4:1 ratio, 2,4,6-tris(2-hydroxy-4-isooctyloxycarbonylisopropylideneoxyphenyl)-s-triazine, 2,4-bis(2,4-dimethylphenyl)-6-(2-hydroxy-4-hexyloxy-5-α-cumylphenyl)-s-triazine, 2-(2,4,6-trimethylphenyl)-4,6-bis[2-hydroxy-4-(3-butyloxy-2-hydroxypropyloxy)phenyl]-s-triazine, 2,4,6-tris[2-hydroxy-4-(3-sec-butyloxy-2-hydroxypropyloxy) phenyl]-s-triazine, mixture of 4,6-bis-(2,4-dimethylphenyl)-2-(2-hydroxy-4-(3-dodecyloxy-2-hydroxypropoxy)-phenyl) Tinuvin® 400, Ciba Specialty Chemicals Corp., 4,6-bis-(2,4-dimethylphenyl)-2-(2-hydroxy-4-(3-(2-ethylhexyloxy)-2-hydroxypropoxy)-phenyl)-s-triazine and 4,6-diphenyl-2-(4-hexyloxy-2-hydroxyphenyl)-s-triazine.

3. Metal deactivators, for example N,N'-diphenyloxamide, N-salicylal-N'-salicyloyl hydrazine, N,N'-bis(salicyloyl) hydrazine, N,N'-bis(3,5-di-tert-butyl-4-hydroxyphenylpropionyl) hydrazine, 3-salicyloylamino-1,2,4-triazole, bis(benzylidene)oxalyl dihydrazide, oxanilide, isophthaloyl dihydrazide, sebacoyl bisphenylhydrazide, N,N'-diacetyladipoyl dihydrazide, N,N'-bis(salicyloyl) oxalyl dihydrazide, N,N'-bis(salicyloyl)thiopropionyl dihydrazide.

4. Phosphites and phosphonites, for example triphenyl phosphite, diphenyl alkyl phosphites, phenyl dialkyl phosphites, tris(nonylphenyl) phosphite, trilauryl phosphite, trioctadecyl phosphite, distearyl pentaerythritol diphosphite, tris(2,4-di-tert-butylphenyl) phosphite, diisodecyl pentaerythritol diphosphite, bis(2,4-di-tert-butylphenyl) pentaerythritol diphosphite, bis(2,6-di-tert-butyl-4-methylphenyl)-pentaerythritol diphosphite, diisodecyloxypentaerythritol diphosphite, bis(2,4-di-tert-butyl-6-methylphenyl)pentaerythritol diphosphite, bis(2,4,6-tris(tert-butylphenyl)pentaerythritol diphosphite, tristearyl sorbitol triphosphite, tetrakis(2,4-di-tert-butylphenyl) 4,4'-biphenylene diphosphonite, 6-isooctyloxy-2,4,8,10-tetra-tert-butyl-dibenzo[d,f][1,3,2]dioxaphosphepin, 6-fluoro-2,4,8,10-tetra-tert-butyl-12-methyl-dibenzo[d,g][1,3,2] dioxaphosphocin, bis(2,4-di-tert-butyl-6-methylphenyl) methyl phosphite, bis(2,4-di-tert-butyl-6-methylphenyl) ethyl phosphite, 2,2',2"-nitrilo[triethyltris(3,3',5,5'-tetra-tert-butyl-1,1 '-biphenyl-2,2'-diyl)phosphite], 2-ethylhexyl(3,3',5,5'-tetra-tert-butyl-1,1 '-biphenyl-2,2'-diyl)phosphite.

Especially preferred are the following phosphites:

Tris(2,4-di-tert-butylphenyl) phosphite (Irgafos® 168, Ciba Specialty Chemicals Corp.), tris(nonylphenyl) phosphite, (A)

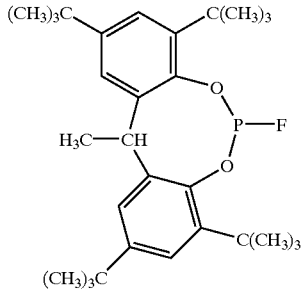

(B)

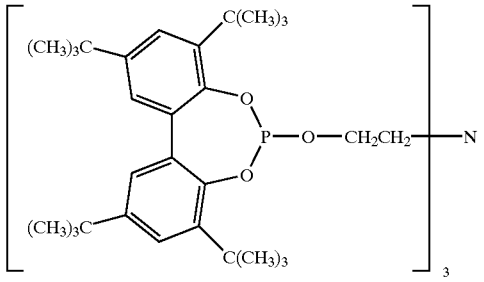

(C)

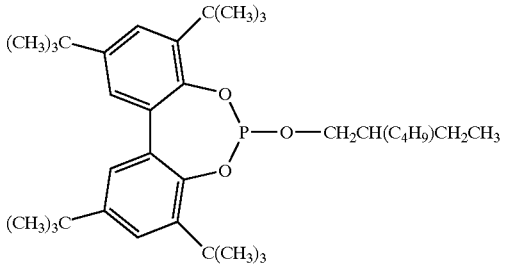

(D)

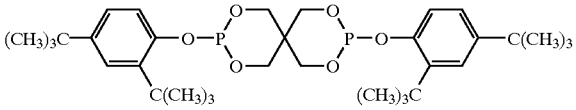

(E)

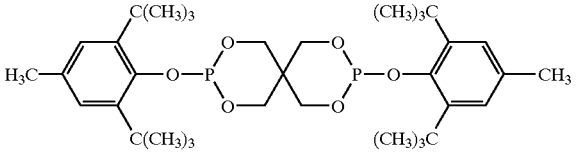

(F)

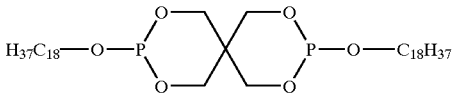

(G)

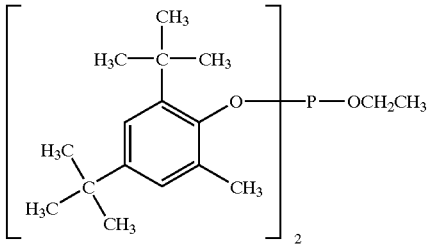

5. Hydroxylamines, for example N,N-dibenzylhydroxylamine, N,N-diethylhydroxylamine, N,N-dioctylhydroxylamine, N,N-dilaurylhydroxylamine, N,N-ditetradecylhydroxylamine, N,N-dihexadecylhydroxylamine, N,N-dioctadecylhydroxylamine, N-hexadecyl-N-octadecylhydroxyl-amine, N-heptadecyl-N-octadecylhydroxylamine, N-methyl-N-octadecylhydroxylamine and the N,N-dialkylhydroxylamine derived from hydrogenated tallow amine.

6. Nitrones, for example N-benzyl-α-phenylnitrone, N-ethyl-α-methylnitrone, N-octyl-α-heptylnitrone, N-lauryl-α-undecylnitrone, N-tetradecyl-α-tridcylnitrone, N-hexadecyl-α-pentadecylnitrone, N-octadecyl-α-heptadecylnitrone, N-hexadecyl-α-heptadecylnitrone, N-ocatadecyl-α-pentadecylnitrone, N-heptadecyl-α-heptadecylnitrone, N-octadecyl-α-hexadecylnitrone, N-methyl-α-heptadecylnitrone and the nitrone derived from N,N-dialkylhydro-xylamine derived from hydrogenate 7. Amine oxides, for example amine oxide derivatives as disclosed in U.S. Pat. Nos. 5,844,029 and 5,880,191, didecyl methyl amine oxide, tridecyl amine oxide, tridodecyl amine oxide and trihexadecyl amine oxide.

8. Benzofuranones and indolinones, for example those disclosed in U.S. Pat. Nos. 4,325,863, 4,338,244, 5,175,312, 5,216,052, 5,252,643; DE-A-4316611; DE-A-4316622; DE-A4316876; EP-A-0589839 or EP-A-0591102 or 3-[4-(2-acetoxyethoxy)-phenyl]-5,7-di-tert-butyl-benzofuran-2-one, 5,7-di-tert-butyl-3-[4-(2-stearoyloxyethoxy)phenyl]-benzofuran-2-one, 3,3'-bis[5,7-di-tert-butyl-3-(4-[2-hydroxyethoxy]phenyl)benzofuran-2-one], 5,7-di-tert-butyl-3-(4-ethoxyphenyl)benzofuran-2-one, 3-(4-acetoxy-3,5-dimethylphenyl)-5,7-di-tert-butyl-benzofuran-2-one, 3-(3,5-dimethyl-4-pivaloyloxyphenyl)-5,7-di-tert-butyl-benzofuran-2-one, 3-(3,4-dimethylphenyl)-5,7-di-tert-butyl-benzofuran-2-one, lrganox® HP-136, Ciba Specialty Chemicals Corp., and 3-(2,3-dimethylphenyl)-5,7-di-tert-butyl-benzofuran-2-one.

9. Thiosynergists, for example dilauryl thiodipropionate or distearyl thiodipropionate.

10. Peroxide scavengers, for example esters of β-thiodipropionic acid, for example the lauryl, stearyl, myristyl or tridecyl esters, mercaptobenzimidazole or the zinc salt of 2-mercapto-benzimidazole, zinc dibutyldithiocarbamate, dioctadecyl disulfide, pentaerythritol tetrakis(β-dodecylmercapto)propionate.

11. Polyamide stabilizers, for example copper salts in combination with iodides and/or phosphorus compounds and salts of divalent manganese.

12. Basic co-stabilizers, for example melamine, polyvinylpyrrolidone, dicyandiamide, triallyl cyanurate, urea derivatives, hydrazine derivatives, amines, polyamides, polyurethanes, alkali metal salts and alkaline earth metal salts of higher fatty acids, for example, calcium stearate, zinc stearate, magnesium behenate, magnesium stearate, sodium ricinoleate and potassium palmitate, antimony pyrocatecholate or zinc pyrocatecholate.

13. Nucleating agents, for example inorganic substances such as talcum, metal oxides such as titanium dioxide or magnesium oxide, phosphates, carbonates or sulfates of, preferably, alkaline earth metals; organic compounds such as mono- or polycarboxylic acids and the salts thereof, e.g. 4-tert-butylbenzoic acid, adipic acid, diphenylacetic acid, sodium succinate or sodium benzoate; polymeric compounds such as ionic copolymers (ionomers).

14. Fillers and reinforcing agents, for example calcium carbonate, silicates, glass fibres, glass bulbs, asbestos, talc, kaolin, mica, barium sulfate, metal oxides and hydroxides, carbon black, graphite, wood flour and flours or fibers of other natural products, synthetic fibers.

15. Dispersing Agents, such as polyethylene oxide waxes or mineral oil.

16. Other additives, for example plasticizers, lubricants, emulsifiers, pigments, dyes, optical brighteners, rheology additives, catalysts, flow-control agents, slip agents, crosslinking agents, crosslinking boosters, halogen scavengers, smoke inhibitors, flameproofing agents, antistatic agents, clarifiers such as substituted and unsubstituted bisbenzylidene sorbitols, benzoxazinone UV absorbers such as 2,2'-p-phenylene-bis(3, 1-benzoxazin-4-one), Cyasorb® 3638 (CAS# 18600-59-4), and blowing agents.

For example, additives commonly used in this art may be optionally incorporated into the dyeable fibers of the present invention. Representative examples of such materials include hydrophilic modifiers such as monoglyceride such as glycerol monostearate, long chain hydrocarbon with hydrophilic groups appended such as a potassium or sodium salt of a linear alkyl phosphate, or combination thereof. The hydrophilic groups may be carboxylates, sulfates, sulfonates, phosphates, phosphonates, as well as quaternary ammonium salts and polyether groups. In addition, swelling agents can be used during dyeing as well as wetting agents, dye compatibilizers and thickening agents such as various gums. Since polyolefin fibers are often used in outdoor applications, such as outdoor carpeting, the addition of UV stabilizers may be advantageously added. Also, antioxidants may be added to the compositions.

In addition, it is contemplated that the present compositions will exhibit improved washability of a polyolefin-based textile fabric or non-woven mat. The nonpolar polyolefin tends to hold onto dirt due to the hydrophobic nature of both. The polyetheresteramide of component (B) is expected to facilitate detergents to penetrate the fabric or matrix so the detergents can loosen and wash away the dirt and oils.

It is also contemplated that the incorporation of polyetheresteramides of component (B) in a polyolefin will increase the absorption and wickability of polyolefin textiles and non-wovens. One example is the melt blown, non-woven absorbent in baby diapers. Making the surface of the non-woven filament more hydrophilic by incorporating the polar polyetheresteramide into the polyolefin is expected to greatly increase the diaper's moisture absorption characteristics.

It is also contemplated that the incorporation of polyetheresteramides of component (B) will increase the abrasion resistance of fibers, fabrics, and other articles. Abrasion resistance is important in the drawing of formed fibers. Typically, a sizing is applied to reduce friction between the fiber and the metal surfaces of the drawing system.

Polyolefin woven and nonwoven fibers and fabrics prepared according to the present invention also exhibit exceptional printability. As a result of their inherent hydrophobic nature, polyolefin fibers and fabrics may exhibit problems towards printability, that is standard printing techniques. The compositions of the present invention overcome these problems as well.

Conventional methods can be employed to dye the fibers of this invention. For instance, the fibers may be dyed in a dye both using conventional dyes and disperse dye techniques. Generally, the dye is applied in the form of a dye solution so that it can be readily applied by dipping the fiber through a trough, for example, containing the dye solution, or by spraying the dye solution on the fiber, or by using a cascading roll technique. As is common, the dye solution can be in the form of a print paste, from which the dyeing is typically conducted by roller printing or screen printing. The fibers can be dyed multiple times using one or more dyeing techniques.

Aqueous dye baths typically have a pH of from about 2 to about 11, generally between about 2 to about 6 for acid dyes. The pH may be adjusted if desired using a variety of compounds, such as formic acid, acetic acid, sulfamic acid, citric acid, phosphoric acid, nitric acid, sulfuric acid, monosodium phosphate, tetrasodium phosphate, trisodium phosphate, ammonium hydroxide, sodium hydroxide, and combinations thereof. Use of a surfactant can be used to aid in dispersing sparingly water soluble disperse dyes in the dye baths. Typically, nonionic surfactants can be employed for this purpose. During the dying step, the dye bath may be agitated to hasten the dyeing ratio. The dyeing step can be carried out at a variety of temperatures, with higher temperatures generally promoting the rate of dyeing.

Another technique known in the art is jet dyeing, which permits high-temperature dyeing and impingement of the dye onto the moving fabric through use of a venturi jet system. Carriers permit faster dyeing at atmospheric pressure and below 100° C. The carriers are typically organic compounds that can be emulsified in water and that affinity for the fiber. Representative examples of such carriers include aromatic hydrocarbons such as diphenyl and methylnaphthalene, phenols such as phenylphenol, chlorinated hydrocarbons such as dichloro-and tricolor-benzene, and aromatic esters such as methyl salicylate, butyl benzoate, diethylphthalate, and benzaldehyde. Carriers are generally removed after dyeing.

Subsequent to dyeing, using a dye mixture with additives above, dry heat may be applied to the fibers at a wide range of elevated temperatures to cause the dye to penetrate into, and become fixed in, the fiber. The dye fixation step involves exposing the fiber to dry heat, such as in an oven. The temperature can vary up to the melt or glass transition temperature of the composition fiber. Generally, higher drying temperatures result in shorter drying times. Typically, the heating time is from about 1 minute to about 10 minutes. Residual dye may then be removed from the fibers.

A disperse dye mixture may thus be applied to the polypropylene fibers in various ways. The dye mixture may be applied intermittently along the length of yarn formed from fibers using various well known techniques to create a desired effect. One suitable method of dyeing fibers may be referred to as the "knit-deknit" dyeing technique. According to this method, the fibers are formed into a yarn which in turn is knit, typically into a tubing configuration. The dye mixture is then intermittently applied to the knit tubing. After dyeing, the tubing is unraveled and the yarn thus has an intermittent pattern. According to an alternative printing method, the fibers are first formed into yarn which is then woven or knitted into fabric, or is tufted into the carpet. A conventional flat screen printing machine may be used for applying the dye mixture to the fabric or carpet.

Continuous dyeing is carried out on a dyeing range where fabric or carpet is continuously passed through a dye solution of sufficient length to achieve initial dye penetration. Some disperse dyes may be sublimated under heat and partial vacuum into polymer fiber by methods known in the art. Printing of polyolefin compositions made in accordance with this invention can be accomplished with disperse dyes by heat transfer printing under pressure with sufficient heating to cause diffusion or disperse dyes into the polyolefin. Block, flat screen, and heat transfer batch processes, and engraved roller and rotary screen printing continuous processes may be used. Different dye solutions may be jet-sprayed in programmed sequence onto fabric or carpet made of the compositions of this invention as the fabric passes under the jets to form patterns. Dye solution may be metered and broken or cut into a pattern of drops that are allowed to drop on a dyed carpet passing underneath to give a diffuse over-dyed pattern on the carpet. Competitive dyeing of polyolefins is useful when dyeing styled carpets consisting of several different fibers such as nylon, polyester, etc., and a polyolefin. Different styling effects can be produced by controlling shade depth on each type of fiber present. Acid, disperse and premetallized dyes, or combinations thereof, depending upon the fibers present, can be employed to obtain styling effects. It may be possible to produce tweed effects by controlling the amount of reaction product and/or polyetheresteramide in the dyeable composition. Print dyeing, space dyeing, and continuous dyeing can be carried out with fabrics made from such yarns.

There are many commercially available disperse dyes. Dyes are classified based on method of application and, to a lesser extent, on chemical constitution by the Society of Dyers and Colorists. Various disperse dyes may be found in the listing "Dyes and Pigments by Color Index and Generic Names" set forth in Textile Chemist and Colorist, July 1992, Vol. 24, No. 7, a publication of the American Association of Textile Chemists and Colorists.

Dyes are intensely colored substances used for the coloration of various substrates, such as paper, plastics, or textile materials. It is believed that dyes are retained in these substrates by physical absorption, by salt or metal-complex formation, or by the formation of covalent chemical bonds. The methods used for the application of dyes to the substrate differ widely, depending upon the substrate and class of dye. It is by applications methods, rather than by chemical constitutions, that dyes are differentiated from pigments. During the application process, dyes lose their crystal structures by dissolution or vaporization. The crystal structures may in some cases be regained during a later stage of the dyeing process. Pigments, on the other hand, retain their crystal or particulate form throughout the entire application procedure.

A large number of dyes, with widely differing properties, are therefore necessary because of the great variety of materials to be dyed. On a worldwide basis, it is believed that several thousand different dyes have achieved commercial significance. Generally, dyes have been classified into groups two ways. One method of classification is by chemical constitution in which the dyes are grouped according to the chromophore or color giving unit of the molecule. A second method of classification is based on the application class of end-use of the dye. The dual classification system used in the color index (Cl) is accepted internationally throughout the dye-manufacturing and dye-using industries. In this system, dyes are grouped according to chemical class with a Cl number for each chemical compound and according to usage or application class with a Cl name for each dye. Disperse dyes are generally water-insoluble nonionic dyes typically used for dyeing hydrophilic fibers from aqueous dispersion. Disperse dyes have been used on polyester, nylon, and acetate fibers.

A number of spin finishes can be applied to the fibers prior to drawing. Such finishes can be water-based. The spin finishes can be anionic or nonionic, as is well known in the art. Also, the fibers can be finished prior to dyeing, as by texturizing through mechanical crimping or forming, as is well known in the art.

The following examples illustrate the invention in more detail. They are not to be construed as limiting the invention in any manner whatsoever.

Additives employed in the following examples:

PEBAX 1074, Elf Atochem, is a polyetheresteramide prepared from PA 12 and polyethylene glycol, with a melting point of 158° C.

PELESTAT 1250, Sanyo Chemical Industries, a polyetheresteramide of the present invention, contains an oxyalkylated bisphenol and has a melting point of ca. 302° F.

PELESTAT 6321, Sanyo Chemical Industries, a polyetheresteramide of the present invention, contains an oxyalkylated bisphenol and has a melting point of ca. 397° F.

IRGASTAB FS 410 is a 1:1 blend of Irgastab® FS-042, an N,N-di(alkyl)hydroxylamine produced by the direct oxidation of N,N-di(hydrogenated tallow)amine and CHIMASSORB 944.

IRGANOX B 1411 is a 1:1 synergistic blend of IRGAFOS 168 and IRGANOX 3114. IRGAFOS 168 is tris(2,4-di-tert-butylphenyl) phosphite, IRGANOX 3114 is tris (3,5-di-tert-butyl-4-hydroxybenzyl) isocyanurate.

IRGANOX XP 620 is a mixture of IRGAFOS 126, bis(2,4-di-tert-butylphenyl) pentaerythritol diphosphite, IRGANOX HP-136, 3-(3,4-dimethylphenyl)-5,7-di-tert-butyl-benzofuran-2-one, and IRGANOX 1010, pentaerythritol tetrakis [3-(3,5-di-tert-butyl4-hydroxyphenyl) propionate].

TINUVIN 234 is 2-(3,5-bis-α-cumyl-2-hydroxyphenyl)-2H-benzotriazole.

TINUVIN 1577 is 4,6-diphenyl-2-(4-hexyloxy-2-hydroxyphenyl)-s-triazine.

CHIMASSORB 81 is 2-hydroxy-4-octyloxybenzophenone.

FLAMESTAB FR 116 is:

(FLAMESTAB 116)

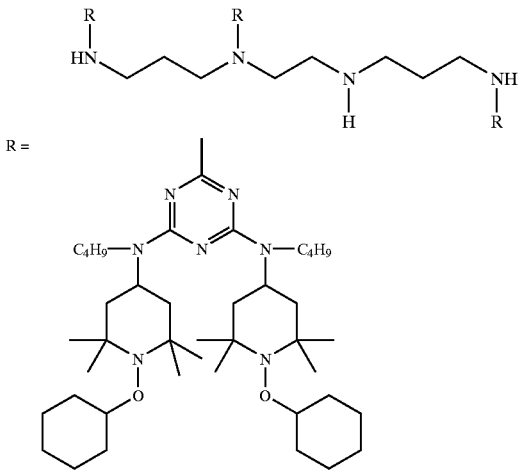

TINUVIN 111 is a synergistic mixture of CHIMASSORB 119 and TINUVIN 622 and TINUVIN 783 is a synergistic mixture of CHIMASSORB 944 and TINUVIN 622:

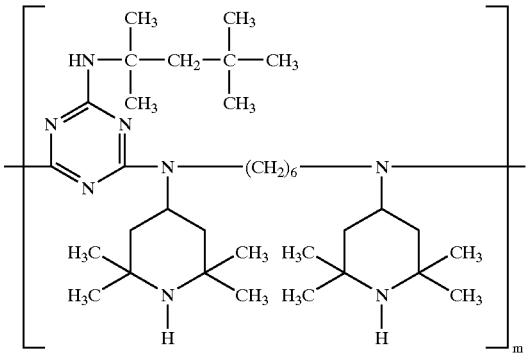

Chimassorb® 944

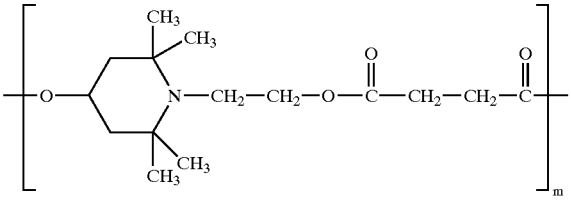

Tinuvin® 622

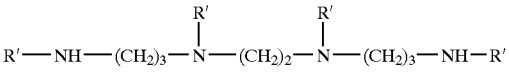

Chimassorb® 119 where R′ is

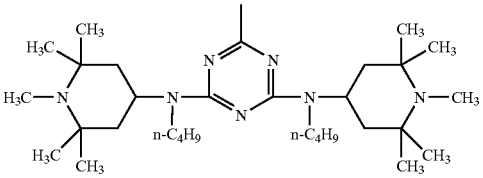

PELESTAT is a trademark of Sanyo Chemical Industries. IRGASTAB, IRGANOX, IRGAFOS, TINUVIN, CHIMASSORB and FLAMESTAB are trademarks of Ciba Specialty Chemicals.

Example 1

Polypropylene Fiber Dyeability

Fiber grade polypropylene, Montell PROFAX 6301, and the appropriate amount of a polyetheresteramide additive are mixed on a TURBULA mixer for 15 minutes. The blended mix is added to a SUPERIOR MPM single screw lab extruder at 425, 450, 475 and 475° F., screw speed is 80 rpm. The molten polypropylene with additive exits a round die, is cooled in a water trough and is fed into a CONAIR JETRO pelletizer. The compounded pellets are fed into a HILLS LAB FIBER EXTRUDER with a 41 hole delta spinneret at 450, 475, 500 and 525° F. A constant pressure of 750 psi controls the screw speed via a feed back loop. The feed, draw, and relax rolls are at 175, 212 and 212° F., and are rotating at 120, 400 and 383 meters per minute. The fiber comes in contact with a 6% aqueous fiber finish solution just before the feed roll. This solution is LUROL PP-4521 from Goulston Industries. A LEESONA winder at the end of the line collects the fiber onto a spool. The final denier per filament is 15. The collected fiber is removed from the spool and is knitted into a sock with a LAWSON HEMPHILL FAK sampler knitter.

Solutions of dyes are prepared at 1.0 g/L in distilled water in separate containers. For disperse dyes this is done by heating water to 145–185° F., then adding water to the dye. The solutions of the acid dyes are made by heating water to 185–212° F. The solutions of the leveler, lubricant and pH control chemicals are made at room temperature at a 10% w/w level.

A ROACHES programmable dye bath is set to the following conditions:

Disperse dye for PP: Temperature rise of 3.5° C. per minute to 98° C. with a hold time of 60 minutes at 98° C then a cool down at maximum cooling of 5.5° C. per minute.

Acid dye for PP: Temperature rise of 3.5° C. per minute to 98° C. with a hold time of 30 minutes at 98° C. then a cool down at maximum cooling of 5.5° C. per minute.

The appropriate amounts of the solutions (see Table 1) are added to a steel 500 mL cylinder based on a 5.0 g weight of sock. The sock is identified with a laundry tag and is placed in the cylinder. The cylinder is filled with distilled water. The pH is checked and should be 4–5 for disperse dyeing and 6–6.5 for acid dyeing. Finally the cylinders are sealed and placed into the dye bath and the cycle is started. After the dye cycle is completed, the socks are removed from the cylinders and are rinsed with tap water. The excess water is removed from the socks via a centrifuge and are dried in a forced air oven at 212° F. for 15 minutes.

Lightness and darkness (L) of the socks are measured on a Datacolor Spectrophotometer SF600. L is a measure of light and dark on a scale of 0 (dark) to 100 (light). Instrument conditions are CIE lab, D65, 10 deg, SCI, SAV, UV400–700. Results are found in Table 2. A lower L value indicates improved dyeability.

TABLE 1

Dye Solutions

| | % Weight on Fiber |
|---|---|
| Acid Dye | |
| IRGALAN Yellow 2GL | 1.0 |
| IRGALAN Bordeaux EL | 0.2 |
| ERIONYL Black MR | 0.3 |
| Sodium phosphate monobasic | 3.0 |
| Tetrasodium pyrophosphate | 1.0 |
| IRGASOL SW | 1.0 |
| Disperse Dye | |
| Yellow K-GL | 0.5 |
| Red K-BB | 0.5 |
| Blue K-RB | 1.0 |
| UNIVADINE DIF | 2.0 |
| CIBAFLUID UA | 1.0 |
| Acetic Acid | 0.5 |

TABLE 2

Dyeability

| Formulation | Additive | L value |
|---|---|---|
| Acid Dye | | |
| A | none | 78.9 |
| B | 5% PELESTAT 1250 | 65.8 |
| C | 5% PEBAX 1074 | 68.2 |
| D | 10% PELESTAT 1250 | 52.6 |
| E | 10% PEBAX 1074 | 53.6 |

TABLE 2-continued

| Formulation | Dyeability Additive | L value |
|---|---|---|
| Disperse Dye | | |
| A | none | 54.2 |
| B | 5% PELESTAT 1250 | 23.4 |
| C | 5% PEBAX 1074 | 29.9 |
| D | 10% PELESTAT 1250 | 19.2 |
| E | 10% PEBAX 1074 | 21.1 |

Additives are reported in weight percent based on polypropylene.

Formulations B and D, containing a polyetheresteramide additive of the present invention, impart improved dyeability to polypropylene socks compared to socks containing no additive and those containing polyetheresteramide additives not of the present invention.

The compositions are also tested for wet and dry crock values. The crocking test method determines the degree of color which may be transferred from the surface of a dyed article to other surfaces by rubbing. Such dye transfer is undesirable. The test requires specific rubbing, via a crockmeter, with both a dry and a wet white test cloth across the dyed article. The cloths are then evaluated via the gray scale. The gray scale is a 5 unit scale (1–5 @ 0.5 divisions), with 5 representing negligible dye transfer.

To qualify as a successful additive to promote polyolefin dyeability, the socks containing the additive should exhibit negligible dye transfer when being evaluated by the crocking test, and there should be no loss of physical properties.

The socks containing the polyetheresteramides of the present invention also show excellent dyeability as evidenced by acceptable wet and dry crock values.

The dyed compositions are also tested for tensile strength. The socks containing the polyetheresteramides of the present invention exhibit no loss of tensile strength compared to socks containing no additive.

Example 2

Polyolefin Dyeability

Following the procedure of Example 1, the following formulations are prepared (all amounts are weight percent) and tested for dyeability:

| | Polyetheresteramide | Antioxidant | UVA | HAS |
|---|---|---|---|---|
| Polypropylene | | | | |
| 97 | 3 | 0.1 | — | 0.2 |
| 95 | 5 | 0.1 | 0.1 | 0.2 |
| 90 | 10 | 0.2 | 0.2 | 0.1 |
| 85 | 15 | 0.2 | 0.2 | 0.3 |
| 80 | 20 | 0.2 | 0.3 | 0.2 |
| 70 | 30 | 0.3 | 0.3 | 0.3 |
| Polyethylene | | | | |
| 95 | 5 | 0.1 | 0.15 | 0.25 |
| 90 | 10 | 0.1 | 0.2 | 0.25 |
| 85 | 15 | 0.2 | 0.2 | 0.3 |
| 75 | 25 | 0.2 | 0.3 | 0.3 |
| 65 | 35 | 0.3 | 0.4 | 0.2 |

Polyetheresteramide additives are selected from PELESTAT 1250 and PELESTAT 6321. Antioxidants are selected from IRGASTAB FS 410, IRGANOX B 1411 and IRGANOX XP 620. Ultraviolet light absorbers (UVAs) are selected from TINUVIN 234, TINUVIN 1577 and CHIMASSORB 81. Hindered amine stabilizers (HAS) are selected from TINUVIN 111, TINUVIN 622, TINUVIN 783, CHIMASSORB 944 and FLAMESTAB FR 116.

The compositions of the present invention further containing additives such as UV absorbers, hindered amines, hydroxylamines, phosphites and phenolic antioxidants exhibit excellent dyeability as evidenced by low L values and acceptable wet and dry crock values.

What is claimed is:

1. A dyeable fiber or filament, comprising a melt blend which comprises (A) a polyolefin; and (B) at least one polyetheresteramide which contains aromatic dial-derived sections wherein the aromatic dials are selected from the group consisting of (I)

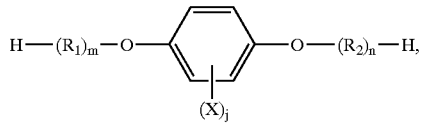

(II)

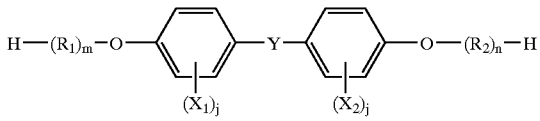

and (III)

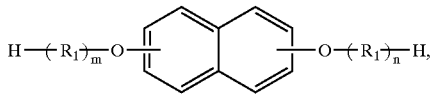

wherein $R_1$ and $R_2$ independently are ethylene oxide or propylene oxide Y is a covalent bond, an alkylene group of 1 to 6 carbon atoms, an alkylidene group, a cyoloalkylidine group, an arylalkylidene group, O, SO, $SO_2$, CO, S, $CF_2$, $C(CF_3)_2$, or NH, X is alkyl having 1 to 6 carbon atoms, halogen, sulfonic acid or sulfonic acid salt, $X_1$ and $X_2$ are independently straight or branched alkyl of 1 to 6 carbon atoms, aralkyl of 6 to 10 carbon atoms aryl, halogen, sulfonic acid or sulfonic acid salt j is 0 to 4 and m and n are independently 1 to 32.

2. A fiber or filament according to claim 1 wherein the polyetheresteramide consists essentially of residues derived from (1) a polyamide oligomer having end units containing a carboxylic group and having a number average molecular weight from 200 to 5,000 and (2) an oxyalkylated bisphenol compound of formula (II) having a number average molecular weight from 300 to 3,000.

3. A fiber or filament according to claim 2 in which in the carboxylic group is derived from adipic, sebacic, terephthalic or isophthalic acids or 3'-sulfoisophthalic acid arkali metal.

4. A fiber or filament according to claim 2 wherein said oxyalkylated bisphenol compound comprises an oxyalkylated alkylidene bisphenol.

5. A fiber or filament according to claim 4 wherein said oxyalkylated alkylidene bisphenol is an oxyalkylated bisphenol A.

6. A fiber or filament according to claim 2 wherein said oxyalkylated bisphenol compound is about 20% to about 80% by weight of the polyetheresteramide.

7. A fiber or filament according to claim 1 in which the polyolefin is polypropylene or polyethylene.

8. A fiber or filament according to claim 1 wherein the weight ratio of the polyetheresteramides of component (B) to the polyolefin of component (A), (B):(A), is from about 0.1:99.9 to about 40:60.

9. A fiber or filament according to claim 1 wherein the polyetheresteramides of component (B), in total, are present from about 1% to about 15% by weight, based on the weight of the polyolefin of component (A).

10. A fiber or filament according to claim 1 further comprising a dye.

11. A bi-component fiber comprising a polyolefin component, wherein the polyolefin component comprises a melt blend comprising components (A) and (B) according to claim 1.

12. A woven or nonwoven fabric comprising knitted or bonded bi-component fibers according to claim 11.

13. A woven or nonwoven fabric comprising knitted or bonded polyolefin fibers or filaments according to claim 1.

14. A woven or nonwoven fabric according to claim 13 wherein the polyolefin is polypropylene or polyethylene.

15. A woven or nonwoven fabric according to claim 13 further comprising a dye.

16. An article of manufacture comprising a woven or nonwoven fabric according to claim 13 selected from the group consisting of woven garments, carpeting, furniture upholstery, automobile upholstery, woven industrial fabrics, disposable diapers, sanitary pads, incontinence pads, wet and dry wipes, wound dressings, spill abatement pads, medical absorbent pads, nonwoven garments, disposable medical garments, felts, pressed sheets, geo-textiles, bipolar filters, packaging materials, envelopes and synthetic paper.

17. A method for imparting permanent dyeability to polyolefin fibers or filaments or woven or nonwoven fabrics made therefrom, comprising melt extruding a mixture comprising a thermoplastic polyolefin and at least one polyetheresteramide which contains aromatic diol-derived sections into a plurality of fibers and cooling the fibers, wherein the aromatic dials are selected from the group consisting of (I)

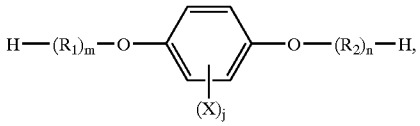

-continued (II)

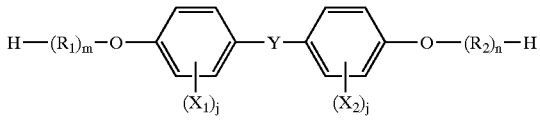

and (III)

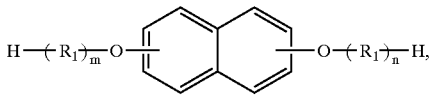

wherein $R_1$ and $R_2$ independently are ethylene oxide or propylene oxide,

Y is a covalent bond, an alkylene group of 1 to 6 carbon atoms, an alkylidene group, a cycloalkylidine group, an arylalkylidene group, O, SO, $SO_2$, CO, S, $CF_2$, $C(CF_3)_2$, or NH, X is alkyl having 1 to 6 carbon atoms, halogen, sulfonic acid or sulfonic acid salt, $X_1$ and $X_2$ are independently straight or branched alkyl of 1 to 6 carbon atoms, aralkyl of 6 to 10 carbon atoms, aryl, halogen, sulfonic acid or sulfonic acid salt, j is 0 to 4 and m and n are independently 1 to 32.

18. A method according to claim 17 wherein the polyetheresteramide consists essentially of residues derived from (1) a polyamide oligomer having end units containing a carboxylic group and having a number average molecular weight from 200 to 5,000 and (2) an oxyalkylated bisphenol compound of formula (II) having a number average molecular weight from 300 to 3,000.

19. A method according to claim 17 wherein the polyolefin is polypropylene or polyathylene.

20. A method according to claim 17 further comprising contacting me fiber, filament or fabric with a dye under conditions effective to dye the fiber.

* * * * *